US006848981B2

(12) United States Patent
Wen et al.

(10) Patent No.: US 6,848,981 B2
(45) Date of Patent: Feb. 1, 2005

(54) DUAL-BULGE FLEXURE RING FOR CMP HEAD

(75) Inventors: Jung-Huang Wen, Shin hua Jen (TW); Te-Wu Wei, Pingtung (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/402,285

(22) Filed: Mar. 27, 2003

(65) Prior Publication Data

US 2004/0192179 A1 Sep. 30, 2004

(51) Int. Cl.[7] ..... B24D 1/00

(52) U.S. Cl. ..... 451/288; 451/41; 451/285; 451/286; 451/398

(58) Field of Search ..... 451/398, 41, 285–289; 92/98 R, 93; 277/634–636

(56) References Cited

U.S. PATENT DOCUMENTS 4,103,901 A * 8/1978 Ditcher ..... 277/606
4,141,180 A * 2/1979 Gill et al. ..... 451/67
4,864,918 A * 9/1989 Martin ..... 92/103 SD
5,228,702 A * 7/1993 Browne et al. ..... 277/608
5,643,061 A * 7/1997 Jackson et al. ..... 451/289
6,027,125 A * 2/2000 Guest ..... 277/602
6,080,050 A * 6/2000 Chen et al. ..... 451/288
6,295,918 B1 * 10/2001 Simmons et al. ..... 92/98 R
6,514,124 B1 * 2/2003 Zuniga et al. ..... 451/41
6,540,594 B2 * 4/2003 Zuniga et al. ..... 451/285
6,602,114 B1 * 8/2003 Wang et al. ..... 451/41

* cited by examiner

*Primary Examiner*—George Nguyen
(74) *Attorney, Agent, or Firm*—Tung & Associates

(57) ABSTRACT

A diaphragm flexure for a polishing head on a chemical mechanical polisher, particularly a Titan (TM) polishing head. The diaphragm flexure includes an annular flexure body having at least one bulge or protrusion formed in the upper surface thereof and at least one bulge or protrusion formed in the lower surface thereof. In assembly of the polishing head, each of the at least one inner and outer bulge or protrusion is inserted in a corresponding groove provided in a surface of an adjacent element of the polishing head. The elements in the polishing head are secured together with the flexure body typically by extending screws through respective screw openings in the elements and the flexure body.

8 Claims, 3 Drawing Sheets

DUAL-BULGE FLEXURE RING FOR CMP HEAD

FIELD OF THE INVENTION

The present invention generally relates to polishing heads for chemical mechanical polishing apparatus in the polishing of semiconductor wafer substrates during the fabrication of integrated circuits, and more particularly, relates to a new and improved diaphragm flexure which includes at least one upper and at least one lower protrusion each of which mates with companion grooves in adjacent elements of the polishing head to facilitate accurate assembly and sealing of the polishing head for a CMP apparatus.

BACKGROUND OF THE INVENTION

Apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad or the polishing head is rotated and oscillates the wafer over the polishing surface. The polishing head is forced downwardly onto the polishing surface by a pressurized air system or similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films.

CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed separately.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing pads of the type described above used in the CMP process are shown in U.S. Pat. No. 4,141,180 to Gill, Jr., et al.; U.S. Pat. No. 5,205,082 to Shendon, et al; and U.S. Pat. No. 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

The polishing pad 12 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surfaces. The hard pads and the soft pads may also be combined in an arrangement of stacked pads for customized applications.

Referring now to FIG. 1C, wherein an improved CMP head, sometimes referred to as a Titan head, which differs from a conventional CMP head in two major respects, is shown. First, the Titan head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

An exploded, perspective view of a Titan CMP head 20 is shown in FIG. 1D and includes an upper assembly or housing 22 and a lower assembly 23 having a flexure clamp 24, a diaphragm flexure 26, a membrane clamp 28, a membrane support 30, a flexible membrane 32, and a retainer ring 34. The membrane 32 is mounted on the bottom surface of the membrane support 30. In assembly of the CMP head 20, the diaphragm flexure 26 is clamped on the membrane support 30, between the flexure clamp 24 and the membrane clamp 28, as follows. First, the membrane clamp 28 is placed on the membrane support 30, with multiple screw openings 29 that extend through the membrane clamp 28 registering with respective screw openings (not shown) provided in the upper surface of the membrane support 30.

Next, the diaphragm flexure 26 is placed on the membrane clamp 28, with multiple screw openings 27 that extend through the diaphragm flexure 26 registering with the respective screw openings 29 in the membrane clamp 28. Next, the flexure clamp 24 is placed on the diaphragm flexure 26, with multiple screw openings (not shown) that extend through the flexure clamp 24 registering with the respective screw openings 27 in the diaphragm flexure 26. Finally, screws 36 are extended through the respective screw openings (not shown) in the flexure clamp 24, the screw openings 27 in the diaphragm flexure 26, the screw openings 29 in the membrane clamp 28 and the screw openings (not shown) in the membrane support 30. The lower assembly 23 and the retaining ring 34 are then mounted inside the upper assembly 22 to complete assembly of the Titan CMP head 23.

A drawback that is frequently encountered in assembling the Titan CMP head 20 is difficulty in facilitating proper alignment of the screw openings 27 of the diaphragm flexure 26 with the screw openings 29 of the membrane clamp 28 prior to extension of the screws 36 through the screw openings 27, 29. This is so due to the elastic and sticky characteristics of the diaphragm flexure 26. In the event that the screw openings are not properly aligned through the membrane clamp 28, the diaphragm flexure 26 and the flexure clamp 24, the screws 36 tend to damage the diaphragm flexure 26, thereby causing leakage of compression air between the membrane 32 and the upper assembly 22. Consequently, the downward pressure applied against the polishing pad (not shown) by the membrane 32 is unstable, thus compromising the CMP polishing removal rate and polishing profile on the wafer surface. Moreover, since the membrane vacuum pressure is important for holding the wafer against the membrane during wafer loading and unloading, loss of the vacuum pressure resulting from air leakage in the CMP head can result in premature falling of the wafer from the CMP head. Accordingly, a new and improved diaphragm flexure is needed to facilitate the precise alignment of screw openings in the diaphragm flexure with respective screw openings in the other elements of the lower assembly in order to provide proper sealing engagement between the membrane and the upper assembly of the CMP head.

An object of the present invention is to provide a new and improved diaphragm flexure for a CMP head.

Another object of the present invention is to provide a new and improved diaphragm flexure which is particularly suitable for Titan (TM) CMP heads.

Still another object of the present invention is to provide a new and improved diaphragm flexure which facilitates ease and accuracy in assembling a CMP head.

Yet another object of the present invention is to provide a new and improved diaphragm flexure which provides an airtight seal between a membrane and an upper assembly or housing of a CMP head to achieve optimal polishing removal rate and polishing profile on a wafer.

A still further object of the present invention is to provide a new and improved diaphragm flexure which includes an annular flexure body having at least one upper bulge or protrusion that mates with a companion groove provided in an element or elements of a CMP head and at least one upper bulge or protrusion which mates with a companion groove provided in another element or elements of the CMP head to facilitate proper alignment and sealing of the elements in the CMP head and achieve optimal vacuum pressure applied to a membrane in the CMP head for obtaining a uniform polishing rate and profile on a wafer.

Yet another object of the present invention is to provide a method of preventing or minimizing air leakage between a membrane and an upper assembly or housing of a CMP head.

SUMMARY OF THE INVENTION

In accordance with these and other objects and advantages, the present invention is generally directed toward a new and improved diaphragm flexure for a polishing head on a chemical mechanical polisher, particularly a Titan (TM) polishing head. The diaphragm flexure includes an annular flexure body having at least one bulge or protrusion formed in the upper surface thereof and at least one bulge or protrusion formed in the lower surface thereof. In assembly of the polishing head, each of the at least one inner and outer bulge or protrusion is inserted in a corresponding groove provided in a surface of an adjacent element of the polishing head. The elements in the polishing head are secured together with the flexure body typically by extending screws through respective screw openings in the elements and the flexure body. The interlocking protrusions and grooves facilitate proper positioning of the flexure body with respect to the adjacent elements to facilitate precise registration or alignment of the screw openings in the flexure body with the screw openings in the elements. This facilitates a precise and secure airtight seal between the membrane and the upper assembly or housing of the polishing head, resulting in uniform application of polishing pressure between a polishing pad and a wafer on the membrane during a CMP process.

The present invention further includes a CMP head which incorporates the diaphragm flexure of the present invention. The CMP head may be quickly and precisely assembled due to the guiding function of the protrusions on the membrane flexure and the receiving grooves on the adjacent elements of the polishing head. The present invention further includes a method of preventing or minimizing leakage of vacuum pressure between a membrane and an upper assembly or housing of a polishing head, which method includes the steps of providing at least one inner circumferential protrusion and at least one outer circumferential protrusion on a membrane flexure for mating with a respective groove or grooves in the adjacent elements of the polishing head in order to ensure proper and precise positioning of screw openings in the membrane flexure and the adjacent elements and extension of screws through the openings.

BRIEF DESCRIPTION OF THE DRAWINGS

The invention will now be described, by way of example, with reference to the accompanying drawings, in which.

DESCRIPTION OF THE PREFERRED EMBODIMENTS

The present invention discloses a new and improved diaphragm flexure for a polishing head on a chemical mechanical polisher, particularly a Titan (TM) CMP head available from Applied Materials, Inc., of Santa Clara, Calif. The diaphragm flexure is designed to facilitate precise alignment of screw openings in the flexure with respective screw openings in the adjacent elements of the polishing head during assembly of the polishing head. Precise alignment of the screw openings facilitates proper placement of fastening screws through the openings, preventing damage to and/or distortion of the membrane flexure. This, in turn, provides optimum vacuum sealing capability between an upper assembly or housing and a resilient membrane on the polishing head to which a wafer adheres for polishing of the wafer against a polishing pad during a CMP process.

Figure 1A:
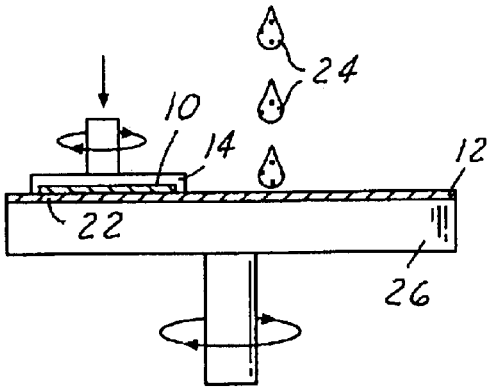
(PRIOR ART) FIG.1A
FIG. 1A is a cross-sectional view of a conventional chemical mechanical polishing apparatus.
Figure 1B:
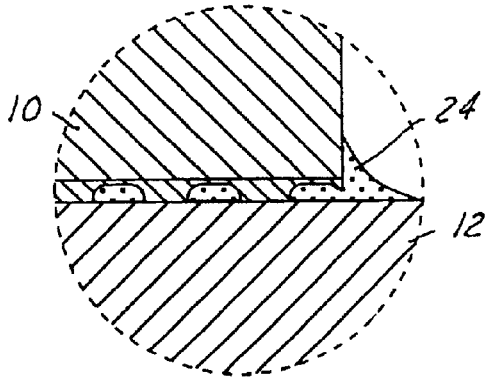
(PRIOR ART) FIG.1B
FIG. 1B is a partial, enlarged cross-sectional view taken from FIG. 1A showing the interaction of slurry between the wafer and the polishing pad.
Figure 1C:
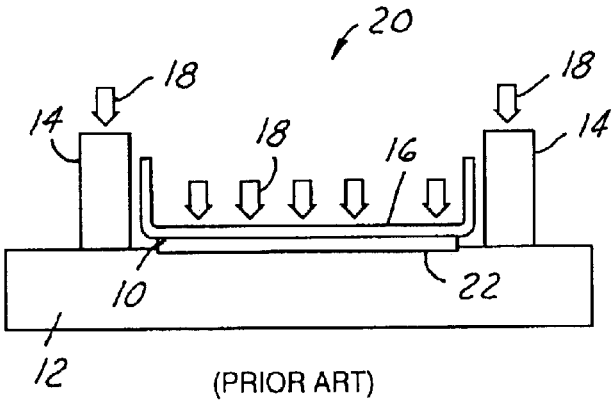
(PRIOR ART) FIG.1C
FIG. 1C is a cross-sectional view illustrating an improved polishing head utilizing a membrane pressuring device.
Figure 1D:
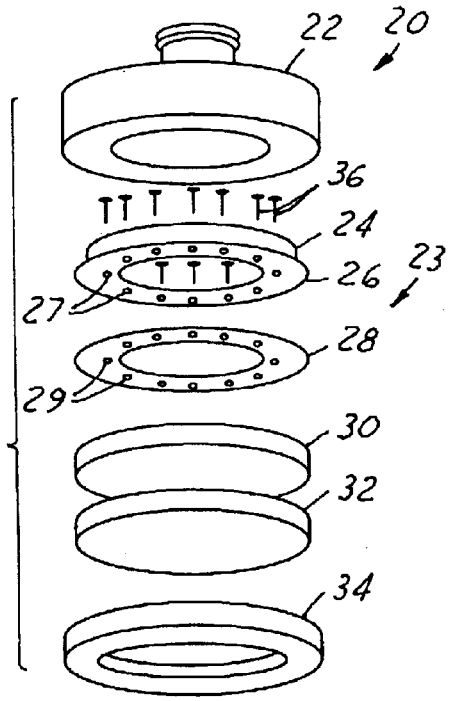
(PRIOR ART) FIG.1D
FIG. 1D is an exploded perspective view of a typical conventional Titan (TM) polishing head for a CMP apparatus.
Figure 2:
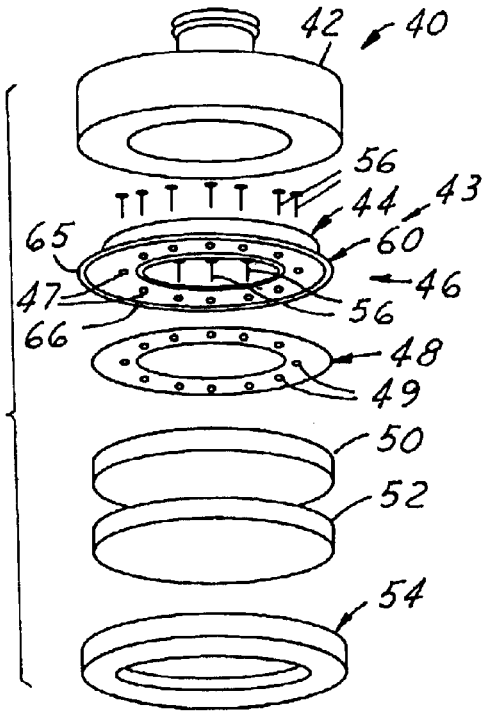
FIG. 2 is an exploded perspective view of a polishing head which utilizes a diaphragm flexure in implementation of the present invention.

Referring initially to FIG. 2, a CMP head 40 in accordance with the present invention is shown. The CMP head 40 includes an upper assembly or housing 42 and a lower assembly 43, having a flexure clamp 44, a diaphragm flexure 46 of the present invention, a membrane clamp 48, a membrane support 50, a flexible membrane 52, and a retainer ring 54.

Figure 3:
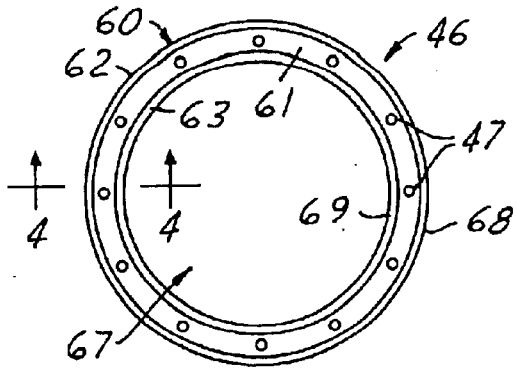
FIG. 3 is a top view of an illustrative embodiment of the diaphragm flexure of the present invention.
Figure 4:
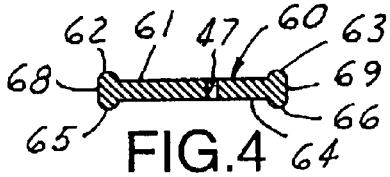
FIG. 4 is a cross-sectional view taken along section line 4—4 in FIG. 3.

Referring next to FIGS. 3 and 4, the diaphragm flexure 46 of the present invention includes an annular flexure body 60 which is typically resilient rubber, as is well-known by those skilled in the art. The flexure body 60 defines a central opening 67 and includes an upper surface 61 and a lower surface 64. An outer upper protrusion 62 may extend upwardly from the upper surface 61, at the outer circumference 68 of the flexure body 60. In like manner, an inner upper protrusion 63 extends upwardly from the upper surface 61, at the inner circumference 69 of the flexure body 60. An outer lower protrusion 65 extends downwardly from the lower surface 64, at the outer circumference 68, and an inner lower protrusion 66 extends downwardly from the lower surface 64, at the inner circumference 69 of the flexure body 60. The purpose of the protrusions 62, 63, 65, 66 will be hereinafter described. Multiple, spaced-apart screw openings 47 extend through the flexure body 60, for purposes which will be hereinafter described.

Figure 5:
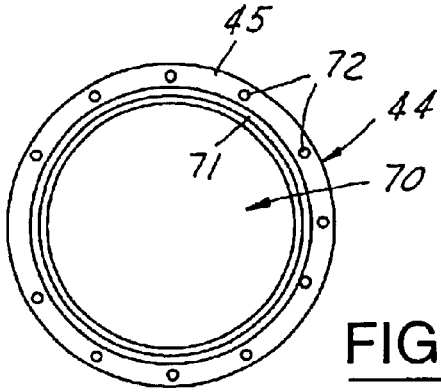
FIG. 5 is a bottom view of a flexure clamp element of the polishing head in implementation of the present invention.

Referring next to FIG. 5, wherein a bottom view of a flexure clamp 44 of the lower assembly 43, in accordance with the present invention, is shown. The annular flexure clamp 44 defines a central opening 70, and an annular groove 71 provided in the bottom surface 45 of the flexure clamp 44 circumscribes the central opening 70. Multiple screw openings 72 extend through the flexure clamp 44 for alignment with the respective screw openings 47 of the flexure body 60, as hereinafter described. In assembly of the lower assembly 43, as hereinafter described, the groove 71 receives the inner upper protrusion 63 of the flexure body 60.

Figure 6:
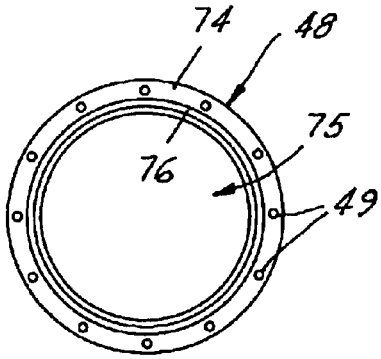
FIG. 6 is a top view of a membrane clamp element of the polishing head in implementation of the present invention.

Referring next to FIG. 6, wherein a top view of a membrane clamp 48 of the lower assembly 43, in accordance with the present invention, is shown. The annular membrane clamp 48 defines a central opening 75. An annular groove 76 is provided in the upper surface 74 of the membrane clamp 48 and circumscribes the central opening 75. Multiple, spaced-apart screw openings 49 extend through the membrane clamp 48 around the groove 76 for alignment with the respective screw openings 47 of the flexure body 60, as hereinafter described. In assembly of the lower assembly 43 as hereinafter further described, the groove 76 receives the inner lower protrusion 66 of the flexure body 60.

Figure 7:
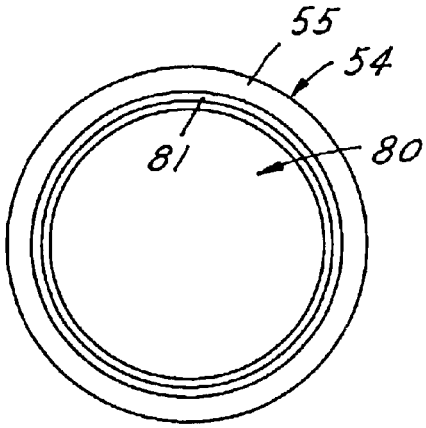
FIG. 7 is a top view of a retainer ring element of the polishing head in implementation of the present invention.

Referring next to FIG. 7, wherein a top view of a retainer ring 54 of the lower assembly 43, in implementation of the present invention, is shown. The annular retainer ring 54 defines a central opening 80. A groove 81 is provided in the upper surface 55 of the retainer ring 54 and circumscribes the central opening 80. In assembly of the lower assembly 43, the groove 81 receives the outer lower protrusion 65 of the flexure body 60 as hereinafter described.

Figure 8:
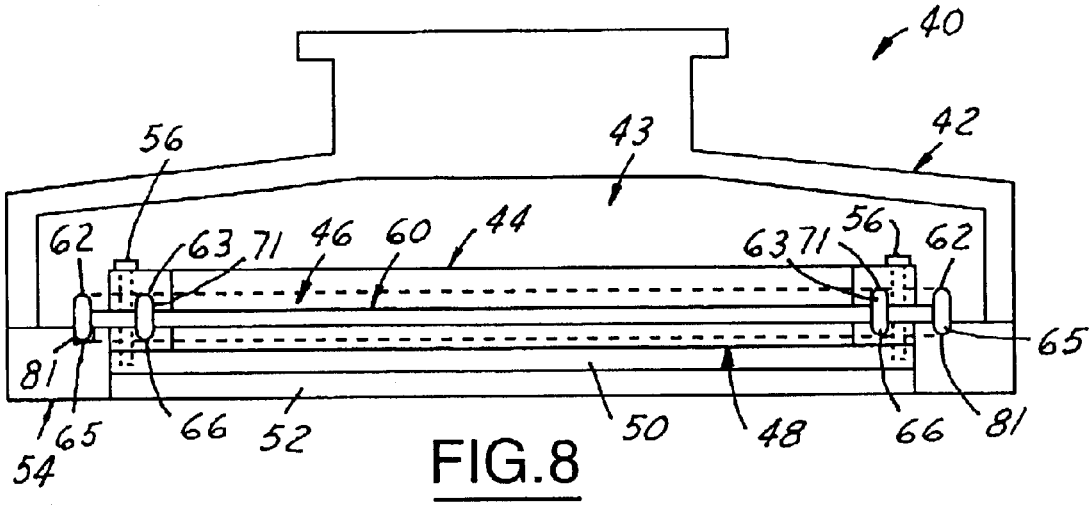
FIG. 8 is a schematic view illustrating an assembled polishing head which utilizes the diaphragm flexure of the present invention.
Figure 9:
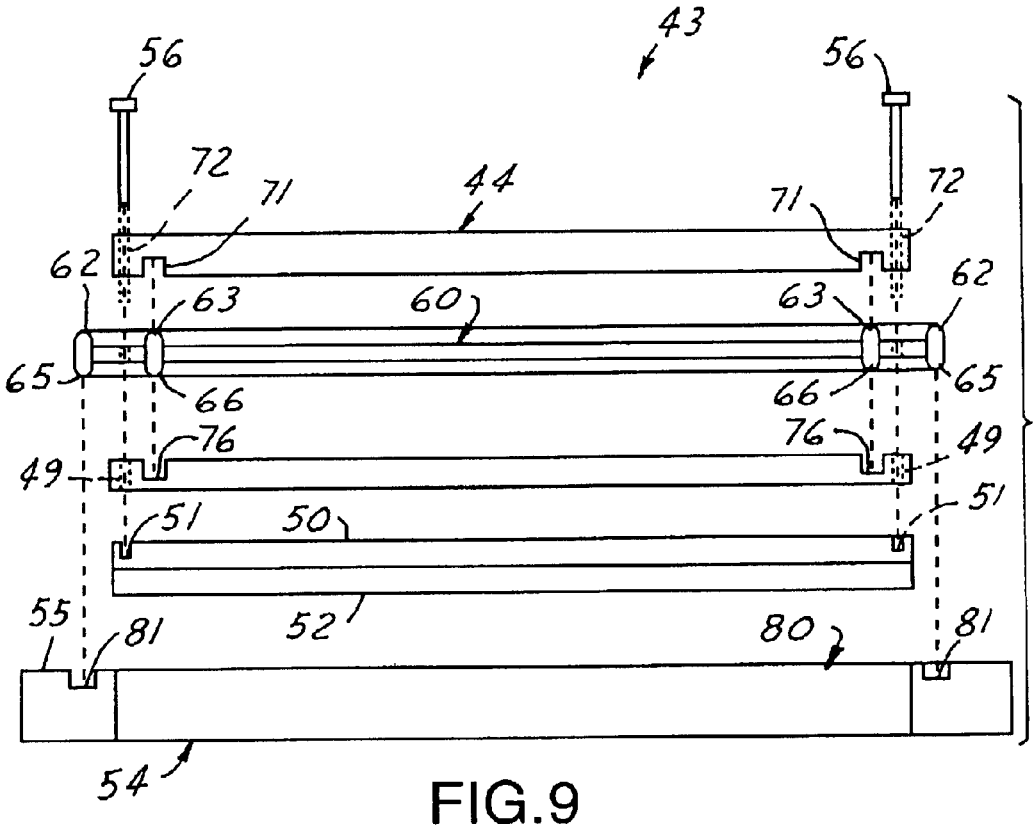
FIG. 9 is an exploded view illustrating assembly of a lower assembly which utilizes the diaphragm flexure of the present invention.

Referring next to FIGS. 2, 8 and 9, the lower assembly 43 of the CMP head 40 is assembled by "sandwiching" the flexure body 60 of the diaphragm flexure 46 between the flexure clamp 44 and the membrane clamp 48 and mounting those elements on the membrane support 50, having the membrane 52 mounted on the bottom surface thereof. Accordingly, the membrane clamp 48 is initially placed on the membrane support 50, with the screw openings 49 of the membrane clamp 48 aligned with the respective screw openings 51 (FIG. 9) of the membrane support 50. As the diaphragm flexure 46 is next placed on the membrane clamp 48, the inner lower protrusion 66 of the flexure body 60 is inserted in the companion groove 76 of the membrane clamp 48 to ensure proper alignment of the screw openings 47 in the flexure body 60 with the respective screw openings 49 in the membrane clamp 48. Next, the flexure clamp 44 is lowered in place on the diaphragm flexure 46 as the inner upper protrusion 63 of the diaphragm flexure 46 is inserted in the companion groove 71 of the flexure clamp 44. This ensures precise alignment or registration of the screw openings 47 in the flexure body 60 with the respective screw openings 72 in the flexure clamp 44. Finally, with the screw openings 72, 47, 49, and 51 aligned in precise registering relationship with respect to each other, multiple screws 56 are extended downwardly through the screw openings 72, 47, 49 and 51, respectively, to fasten the flexure clamp 44, the diaphragm flexure 46, the membrane clamp 48, the membrane support 50 and the membrane 52 together in the lower assembly 43. Next, the partially-assembled lower assembly 43 is mounted in the upper assembly or housing 22 according to the knowledge of those skilled in the art. Finally, as the retainer ring 54 is mounted on the upper assembly or housing 42, according to conventional techniques known by those skilled in the art, the outer lower protrusion 65 of the flexure body 60 is inserted in the groove 81 in the upper surface 55 of the retainer ring 54.

With regard to the assembled CMP head 40 shown in FIG. 8, it will be appreciated by those skilled in the art that because the screw openings in the flexure body 46 are precisely aligned with the respective screw openings in the flexure clamp 44 and the membrane clamp 48, respectively, the screws 56 hold the lower assembly 43 together without distorting, tearing or otherwise damaging the flexure body 60 during a CMP operation, in which a polishing pad (not shown) mounted on the bottom surface of the membrane 52 is pressed downwardly against the upper surface of a wafer (not shown). Consequently, vacuum pressure is maintained between the membrane 52 and the housing 42, such that uniform polishing pressure can be applied by the membrane against the wafer. This results in substantially uniform polishing rates and profiles among all regions on the surface of the wafer. Additionally, the wafer can be securely held by vacuum pressure against the membrane during the wafer loading and unloading procedure.

While the preferred embodiments of the invention have been described above, it will be recognized and understood that various modifications can be made in the invention and the appended claims are intended to cover all such modifications which may fall within the spirit and scope of the invention.

What is claimed is:

1. A CMP head comprising:

a housing;

a flexure clamp having a flexure clamp groove provided in said housing;

a diaphragm flexure having an upper protrusion inserted in said groove and a lower protrusion provided on said diaphragm flexure;

a membrane clamp having a membrane clamp groove receiving said at least one lower protrusion; and a membrane carried by said membrane clamp.

2. The CMP head of claim 1 further comprising a retaining ring having a ring groove and further comprising a second lower protrusion provided on said diaphragm flexure and inserted in said ring groove.

3. The CMP head of claim 1 further comprising a second upper protrusion provided in spaced-apart relationship to said upper protrusion on said diaphragm flexure.

4. The CMP head of claim 3 further comprising a retaining ring having a ring groove and further comprising a second lower protrusion provided on said diaphragm flexure and inserted in said ring groove.

5. A method of assembling a CMP head, comprising the steps of:

providing a membrane clamp having a membrane clamp groove;

providing a diaphragm flexure having an upper protrusion and a lower protrusion;

inserting said lower protrusion in said membrane clamp groove;

providing a flexure claim having a flexure clamp groove;

inserting said upper protrusion in said flexure clamp groove; and fastening said membrane clamp, said diaphragm flexure and said flexure clamp together.

6. The method of claim 5 further comprising a plurality of screw openings in each of said membrane clamp, said diaphragm flexure and said flexure clamp, and wherein said fastening said membrane clamp, said diaphragm flexure and said flexure clamp together comprises the step of extending a plurality of fasteners through said screw openings, respectively.

7. The method of claim 5 further comprising a second lower protrusion provided on said diaphragm flexure and further comprising the steps of providing a retaining ring having a ring groove and inserting said second lower protrusion in said ring groove.

8. Method of claim 7 further comprising a plurality of screw openings in each of said membrane clamp, said diaphragm flexure and said flexure clamp, and wherein said fastening said membrane clamp, said diaphragm flexure and said flexure clamp together comprises the step of extending a plurality of fasteners through said screw openings, respectively.

* * * * *